US011583048B2

(12) United States Patent
Schmidt

(10) Patent No.: US 11,583,048 B2
(45) Date of Patent: Feb. 21, 2023

(54) BAG WITH TRANSPARENT COMPARTMENT

(71) Applicant: Lenora Schmidt, Solen, ND (US)

(72) Inventor: Lenora Schmidt, Solen, ND (US)

( * ) Notice: Subject to any disclaimer, the term of this patent is extended or adjusted under 35 U.S.C. 154(b) by 0 days.

(21) Appl. No.: 17/071,265

(22) Filed: Oct. 15, 2020

(65) Prior Publication Data

US 2021/0106110 A1 Apr. 15, 2021

Related U.S. Application Data

(60) Provisional application No. 62/915,113, filed on Oct. 15, 2019.

(51) Int. Cl.
*A45C 13/02* (2006.01)

(52) U.S. Cl.
CPC ..... *A45C 13/02* (2013.01); *A45C 2200/10* (2013.01); *A45C 2200/20* (2013.01)

(58) Field of Classification Search
CPC .. A45C 13/02; A45C 2200/10; A45C 2200/20
See application file for complete search history.

(56) References Cited

U.S. PATENT DOCUMENTS 1,464,176 A * 8/1923 Freund ..... A45C 3/06 150/117
3,443,671 A * 5/1969 Dyke ..... A45C 7/0027 190/103
3,763,972 A * 10/1973 Karzmar ..... A45C 9/00 383/110
4,830,154 A * 5/1989 Gerch ..... A45C 3/00 190/103
5,255,833 A * 10/1993 McAllister ..... A45F 3/02 150/110
5,799,791 A * 9/1998 Harley ..... A47G 1/12 190/102
5,896,962 A * 4/1999 Smith ..... A45C 3/00 190/107
6,047,752 A * 4/2000 Southwick ..... A45C 3/00 150/112
6,076,641 A * 6/2000 Kinzer ..... A45C 5/14 16/18 CG
6,286,462 B1 * 9/2001 Burns ..... A01K 1/0254 119/497

(Continued)

OTHER PUBLICATIONS

Smarty Duffle Bag, https://www.thesmartyco.com/collections/most-sold-products/products/heavy-duty-clear-gym-duffel-bag (Year: 2019).*

(Continued)

*Primary Examiner* — Tri M Mai
(74) *Attorney, Agent, or Firm* — Boudwin Intellectual Property; Daniel Boudwin

(57) ABSTRACT

A bag with a transparent compartment is shown and described. The bag with a transparent compartment includes a first compartment. The first compartment includes a base having a plurality of sidewalls rising therefrom and a top section secured to the sidewalls at an end opposite the base. At least one of the sidewalls is comprised of a transparent material. An opening is located through the top section. The opening leads into the first compartment and the opening is further comprised of a closure device.

15 Claims, 6 Drawing Sheets

(56) References Cited

U.S. PATENT DOCUMENTS

| | | | | |
|---|---|---|---|---|
| 6,386,414 | B1 * | 5/2002 | Kilduff | A01K 1/0254 224/638 |
| 6,491,074 | B1 * | 12/2002 | Roegner | A45C 1/06 150/112 |
| 6,923,302 | B2 * | 8/2005 | Godshaw | A45C 3/00 190/109 |
| 7,093,323 | B2 * | 8/2006 | Morenstein | A45C 13/26 190/117 |
| 2004/0251102 | A1 * | 12/2004 | Kirincic | A45C 3/001 190/108 |
| 2007/0267114 | A1 * | 11/2007 | Greiner | A45C 13/02 150/112 |
| 2011/0243479 | A1 * | 10/2011 | Alieri | B65D 33/1691 383/5 |
| 2013/0048457 | A1 * | 2/2013 | Sbordoni | A01K 1/0254 190/18 A |
| 2014/0158565 | A1 * | 6/2014 | Abdill | A45C 13/001 206/292 |
| 2015/0000805 | A1 * | 1/2015 | Whitaker | A45C 3/08 150/105 |

OTHER PUBLICATIONS

Smarty products, https://www.thesmartyco.com/ (Year: 2020).*
Kcliffs Backpack, https://www.amazon.com/K-Cliffs-Backpack-Through-Daypack-Transparent/dp/B01BMYM6OK?pd_rd_w=q6mVC&pf_rd_p=07442e57-5bbc-4b36-bdb2-92a549250cee&pf_rd_r=F6NC4KRJP5CA0K17QBTF&pd_rd_r=97151d44-2429-47a2-a43e-4592d4e4c414&pd_rd_wg=hE5R9&th=1, (Year: 2018).*

* cited by examiner

BAG WITH TRANSPARENT COMPARTMENT

CROSS REFERENCE TO RELATED APPLICATIONS

This application claims the benefit of U.S. Provisional Application No. 62/915,113 filed on Oct. 15, 2019. The above identified patent application is herein incorporated by reference in its entirety to provide continuity of disclosure.

BACKGROUND OF THE INVENTION

The present invention relates to bags for everyday use. More particularly, the present invention provides a bag with a transparent compartment.

Many times, day bags are extremely useful. They can contain a large number of needed items in one convenient location. However, often times this location is not so convenient. The items stored within the bag often become tangled together. Further, it can be difficult to sort through the bag to find a specific item. This means that often times a bag's contents will have to be emptied in order to find a desired item.

In a specific instance, a day bag is a diaper bag. A diaper bag will contain many items needed for the day to day needs of a baby. However, often times when a baby needs tending to, the child is crying. This means that a caretaker will want to quickly solve the issue or tend to the child in order to quiet the child. This process can be severely hindered using a normal bag where it can be difficult to quickly locate specific items. Further, often times a baby will need to be tended to in public. It can be a severe inconvenience to have to empty the contents of a bag in a public location to retrieve an item.

Consequently, there is a need for an improvement in the art of everyday bags. The present invention substantially diverges in design elements from the known art while at the same time solving a problem many people face when using a bag to store items that are needed on a day to day basis. In this regard the present invention substantially fulfills these needs.

SUMMARY OF THE INVENTION

The present invention provides a bag with a transparent compartment wherein the same can be utilized for providing convenience for the user when using a day to day bag. The bag with a transparent compartment is comprised of a first compartment. The first compartment includes a base having a plurality of sidewalls rising therefrom and a top section secured to the sidewalls at an end opposite the base. At least one of the sidewalls is comprised of a transparent material. An opening is located through the top section. The opening leads into the first compartment and the opening is further comprised of a closure device.

Another object of the bag with a transparent compartment is to have the base, the top section, and at least two sidewalls of the plurality of sidewalls contain extra material secured between a closure device. The first compartment will expand when the closure device is not secured together.

Another object of the bag with a transparent compartment is to have at least one handle secured to the top section.

Another object of the bag with a transparent compartment is to have a cup holder pocket secured to at least one of the sidewalls.

Another object of the bag with a transparent compartment is to have a first openable side compartment. The first openable side compartment is fixed to the base and openably secured to at least one sidewall and the top section.

Another object of the bag with a transparent compartment is to have a second openable side compartment. The second openable side compartment is fixed to the base and openably secured to at least one sidewall and the top section.

Another object of the bag with a transparent compartment is to have the first openable side compartment include a plurality of elastic holders therein.

Another object of the bag with a transparent compartment is to have the second openable side compartment include a plurality of elastic holders therein.

Another object of the bag with a transparent compartment is to have the first openable side compartment include a plurality of pockets therein.

Another object of the bag with a transparent compartment is to have the first openable side compartment include a plurality of pockets therein.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
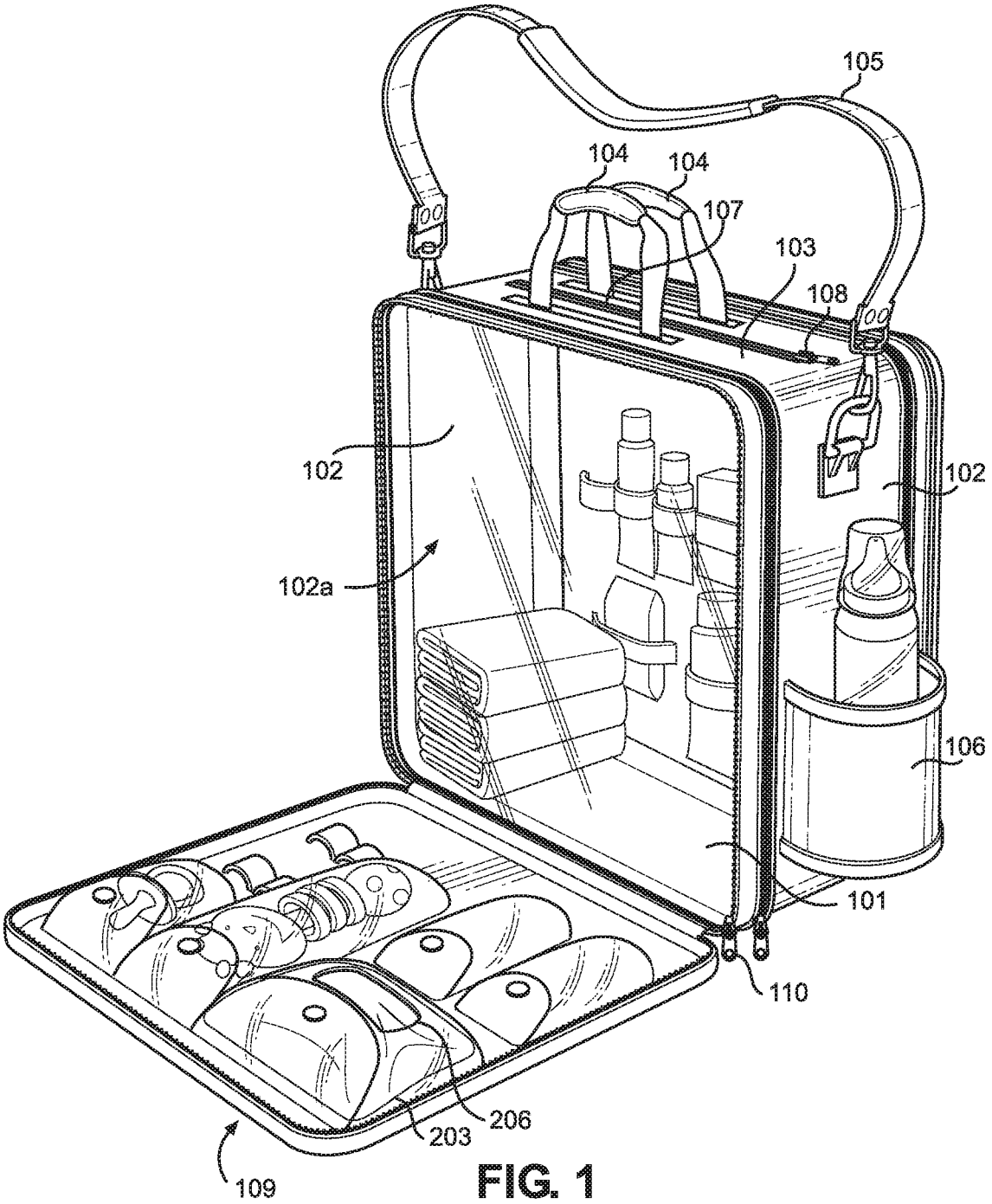
FIG. 1 shows a perspective view of the bag with a transparent compartment having one side opened.

Reference is made herein to the attached drawings. Like reference numerals are used throughout the drawings to depict like or similar elements of the bag with a transparent compartment. For the purposes of presenting a brief and clear description of the present invention, a preferred embodiment will be discussed as used for the bag with a transparent compartment. The figures are intended for representative purposes only and should not be considered to be limiting in any respect.

Referring now to FIG. 1, there is shown a perspective view of the bag with a transparent compartment having one side opened. The bag with a transparent compartment is comprised of a base 101 with a plurality of sidewalls 102 rising therefrom. At least one of the sidewalls 102 is made from a transparent material. In the illustrated embodiment, the plurality of sidewalls comprises a pair of transparent sidewalls 102*a* and a pair of support sidewalls 102. A top section 103 is secured to the sidewalls opposite the base 101. This creates a first compartment having an interior volume. At least one of the sidewalls 102 is made from a transparent material. This will allow for maximum viewing into compartment.

In one embodiment, the top section 103 has at least one handle 104 attached thereto. In the shown embodiment, there are two handles 104 secured to the top section 103. In another embodiment, the bag further includes a shoulder strap 105. In one embodiment, the shoulder strap 105 is removably secured to the bag. This will allow the shoulder strap 105 to be removed from the bag and stored within. In another embodiment, there is at least one side pocket 106 secured to a sidewall 102. In one embodiment, the side pocket 106 is configured to hold a bottle.

In some embodiments, the top section 103 has an opening 107 therethrough. The opening 107 has a fastener 108 secured around the perimeter thereof. In the shown embodiment the separate handles 104 will further all for access to the opening 107. In one embodiment the fastener 108 is a zipper. This will enable the opening 107 to be repeatedly opened and closed. Further, this will allow individuals to safely store items within the compartment.

In some embodiments, the bag has a first side compartment. In the shown embodiment, the first side compartment is adjacent to the shown transparent sidewall 102*a*. The first side compartment is comprised of a flap 109 secured to the base 101 of the bag. This will allow the flap 109 to fold down exposing the interior of the first side compartment. Further, this will allow one to see through the transparent sidewall 102*a*. In one embodiment, the flap 109 has an attachment device 110 located around at least part of the perimeter of the flap 109. In one embodiment the attachment device 110 is a zipper. This will allow the flap 109 to be opened and closed.

Figure 2:
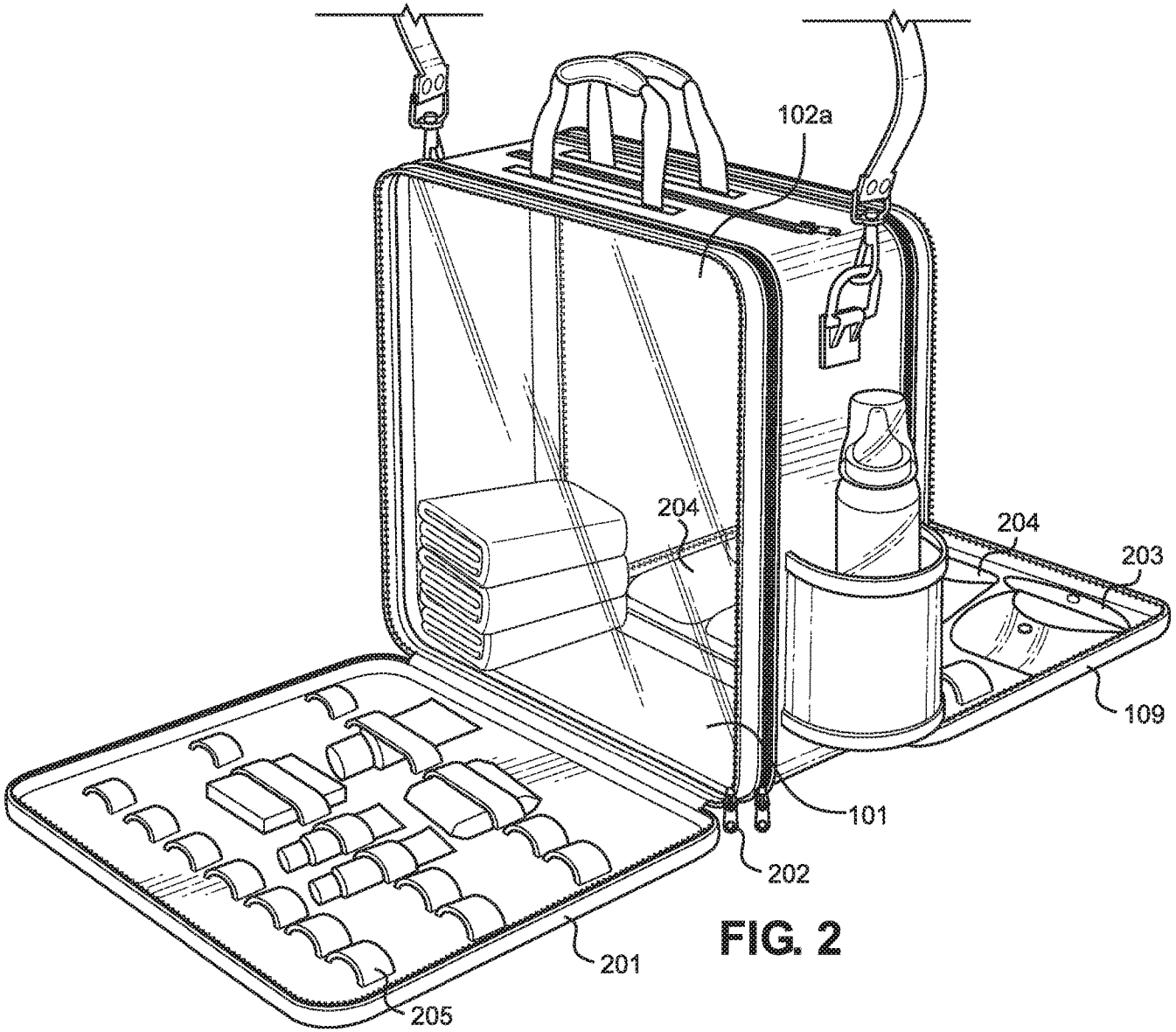
FIG. 2 shows a perspective view of the bag with a transparent compartment having two sides opened.

Referring now to FIG. 2, there is shown a perspective view of the bag with a transparent compartment having two sides opened. In another embodiment, the bag has two transparent sidewalls 102*a* In the shown embodiment, the transparent sidewalls 102*a* are opposed to each other. This will allow an individual to see into the compartment from multiple different sides.

In one embodiment, the bag includes a second side compartment. In the shown embodiment, the second side compartment is adjacent to the shown transparent sidewall 102*a*. The second side compartment is comprised of a second flap 201 secured to the base 101 of the bag. This will allow the second flap 201 to fold down exposing the interior of the second side compartment. Further, this will allow one to see through the transparent sidewall 102A. In one embodiment, the second flap 201 has an attachment device 202 located around at least part of the perimeter of the second flap 201. In one embodiment, the attachment device 202 is a zipper. This will allow the second flap 201 to be opened and closed.

The side compartments can further serve the purpose of protecting the transparent sidewalls 102*a*. The flap material 109, 201 is made of a resilient material that will prevent damage from occurring to the bag. In different embodiments there are different compartments 203, pockets 204, and holders 205 secured to the flaps 109, 201.

In one embodiment there is a plurality of pockets 204 which have an interior volume and will hold different devices. In another embodiment, there is at least one compartment 203 (also annotated in FIG. 1). In one embodiment, the at least one compartment 203 is configured to hold a package of baby wipes. In one embodiment, the compartment 203 will allow for the wipes to be individually removed without removing the entire package. In this embodiment there is a wipe slot 206, shown in FIG. 1. This will allow for the wipes to be removed from a wipe container. In other embodiments, there are a plurality of holders 205. In one embodiment, the holders are elastic loops. In this embodiment, the holders 205 will secure different lotions, salves, and containers of bodily products.

Figure 3:
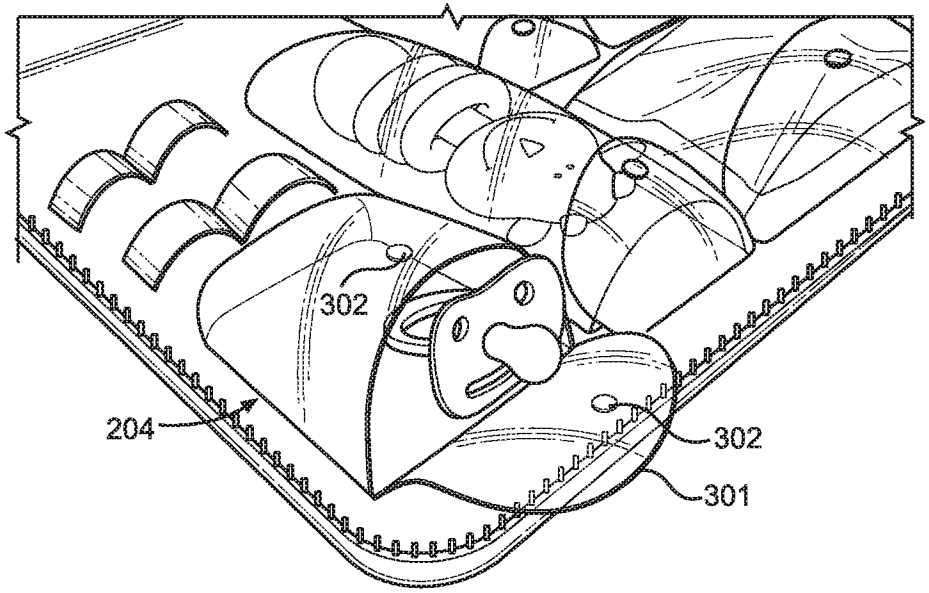
FIG. 3 shows a close-up view of an embodiment of one of the sides of the bag with a transparent compartment.

Referring now to FIG. 3, there is shown a close-up view of an embodiment of one of the sides of the bag with a transparent compartment. In one embodiment, the pockets 204 have top covers 301. These top covers 301 will better contain items within the pockets 204. In a further embodiment, the top covers 301 include fasteners 302. These fasteners 302 will secure to second fasteners located on the pockets 204. In one embodiment, these fasteners 302 are magnetic fasteners. This will allow for quick access to the pockets 204.

Figure 4A:
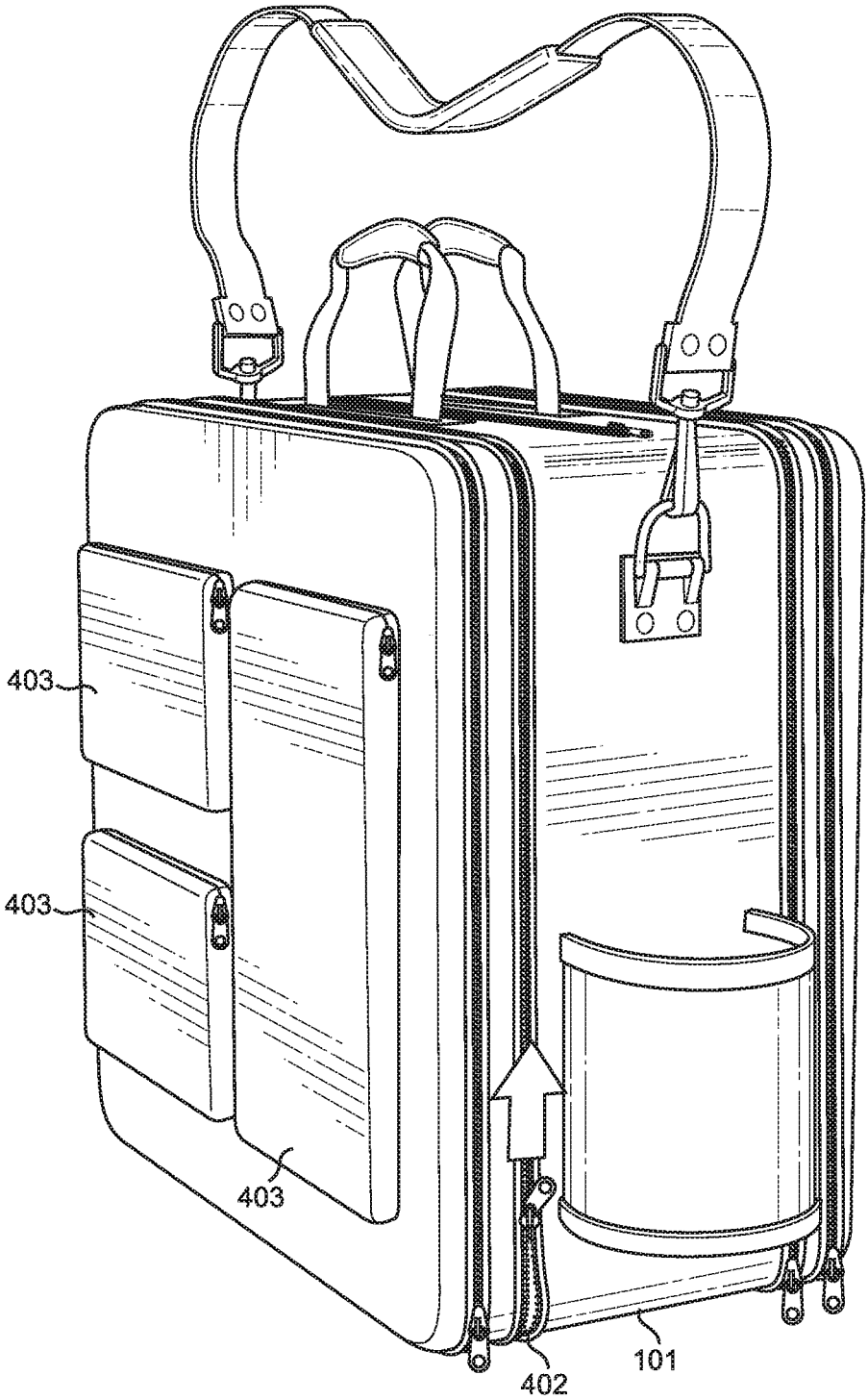
FIG. 4A shows a perspective view of an embodiment of the bag with a transparent compartment in a fully closed position.
Figure 4B:
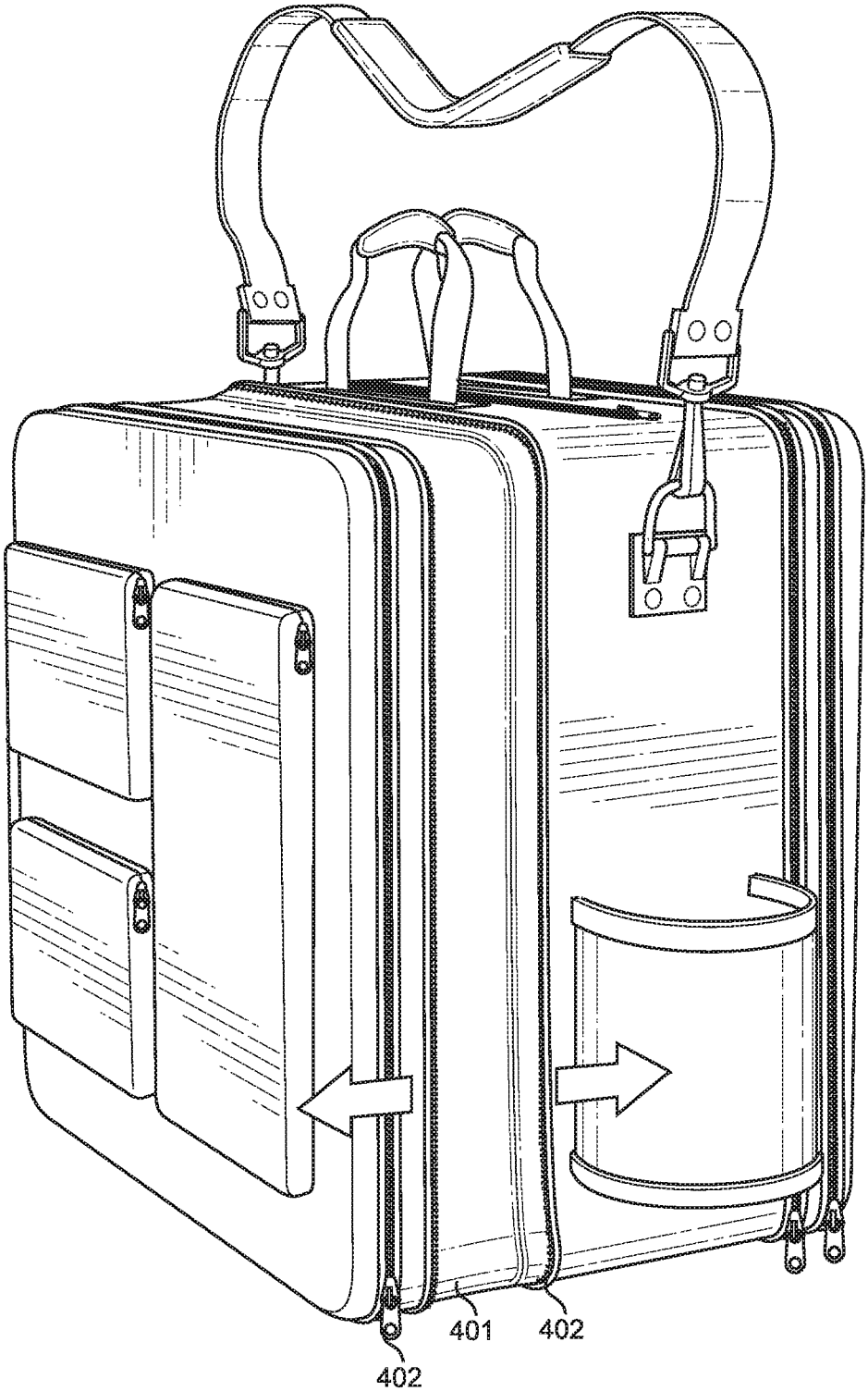
FIG. 4B shows a perspective view of an embodiment of the bag with a transparent compartment in an expanded position.

Referring now to FIG. 4A and FIG. 4B, there is shown perspective views of an embodiment of the bag with a transparent compartment in a fully closed position and an expanded position. In one embodiment, the base 101, several of the plurality of sidewalls 102, and the top section 103 include extension members 401. The extension members 401 are made of a flexible material. The extension members 401 are located between two parts of a fastener 402. In one embodiment, the fastener 402 is a zipper. When the fastener 402 is opened the extension members 401 will expand and will allow for additional area to be added to the interior volume of the compartment.

In one embodiment, the exterior of the bag with a transparent compartment includes at least one pocket 403. In the shown embodiment, there are three pockets 403 of different shapes and sizes. In other embodiments, the pockets 403 may be in additional shapes and sizes. The pockets 403 will allow for easy access to stored items.

Figure 5:
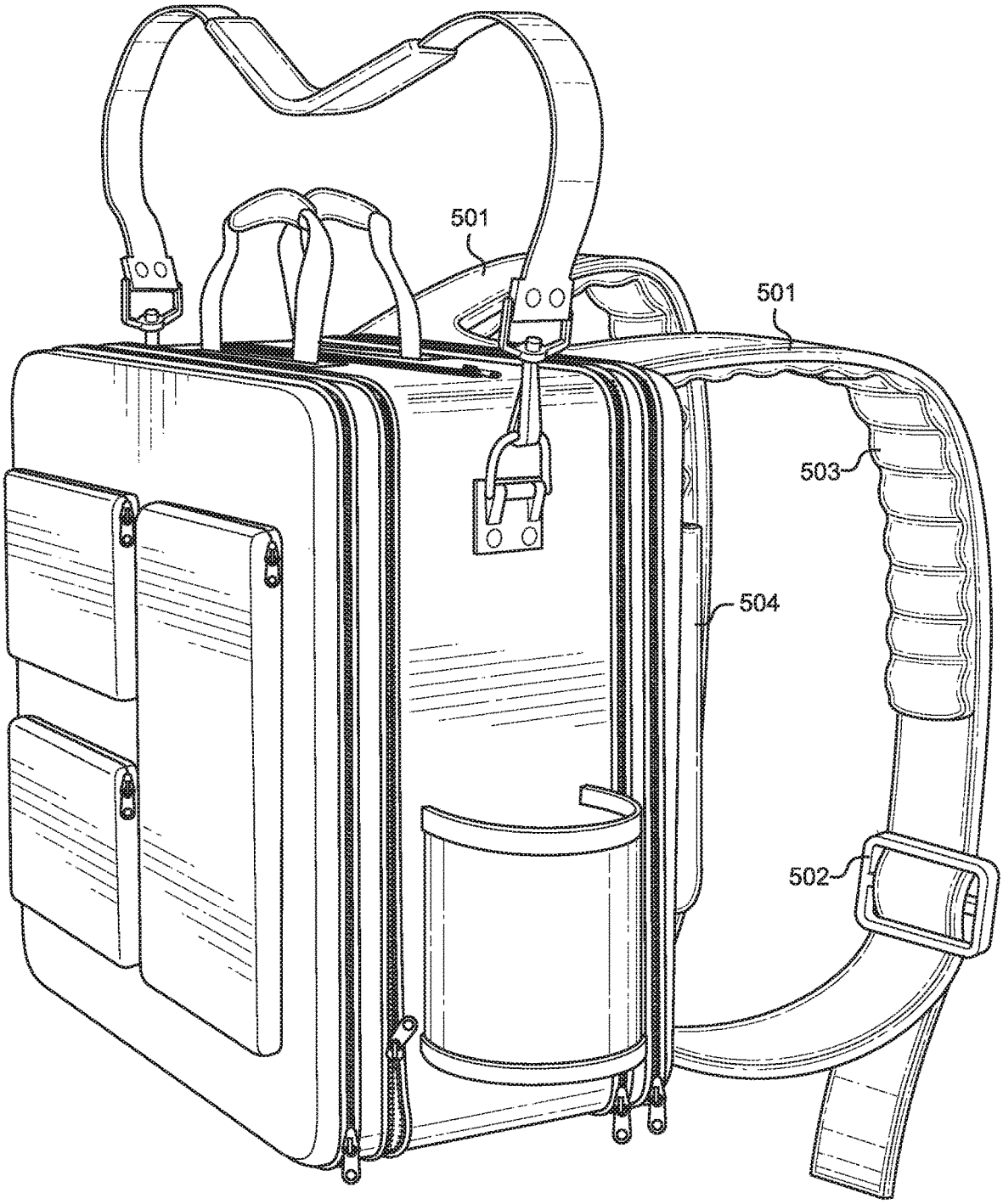
FIG. 5 shows a perspective view of an embodiment of the bag with a transparent compartment including backpack straps.

Referring now to FIG. 5, there is shown a perspective view of an embodiment of the bag with a transparent compartment including backpack straps. In one embodiment backpack straps 501 are secured to the bag. This will allow for the bag to be easily carried. In one embodiment the backpack straps 501 are adjustable in length via an adjuster 502. In the shown embodiment the adjuster 502 is a sliding adjuster. This adjuster 502 will allow a portion of the backpack strap to be pulled there though and adjusted. In yet a further embodiment the backpack straps 501 are padded straps. The padding 503 is located on the interior of the backpack straps 501 such that it will rest against a wearer's shoulders.

In one embodiment the bag with a transparent compartment further includes a connection sleeve 504. The connection sleeve 504 will allow the bag to be secured to a handle. In one embodiment the handle is that of a wheeled cart. In another embodiment the handle is one a wheeled piece of luggage. The connection sleeve 504 will allow for easy connection and thus easy to transport the bag.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bag with a transparent compartment, the bag comprising:

a first compartment comprised of a base having a plurality of sidewalls rising therefrom and a top section secured to the sidewalls at an end opposite the base;

the plurality of sidewalls consisting of a pair of transparent sidewalls and a pair of support sidewalls;

the pair of transparent sidewalls each consisting of a transparent material;

a pair of extension members defined between each transparent sidewall and the pair of support sidewalls;

a pair of flaps secured to the base of the first compartment;

each flap of the pair of flaps securable to a corresponding transparent sidewall via an attachment device;

an opening located through the top section;

wherein the opening leads into the first compartment;

the opening comprising a closure device;

a pair of handles, wherein each handle of the pair of handles is disposed on the top section of the first compartment on opposing sides of the opening.

2. The bag with a transparent compartment of claim 1, further comprising a handle secured to the top section.

3. The bag with a transparent compartment of claim 1, further comprising a cup holder pocket secured to at least one support sidewall of the pair of support sidewalls.

4. The bag with a transparent compartment of claim 1, wherein at least one flap of the pair of flaps includes a plurality of elastic holders on an internal surface thereof.

5. The bag with a transparent compartment of claim 1, wherein at least one flap of the pair of flaps comprises a plurality of pockets on an internal surface thereof.

6. The bag with a transparent compartment of claim 1, wherein the opening terminates at a distance from a pair of edges of the top section.

7. The bag with a transparent compartment of claim 1, wherein a fastener is disposed around the perimeter of each transparent sidewall and the pair of support sidewalls, such that the extension members may be secured.

8. The bag with a transparent compartment of claim 1, wherein at least one flap of the pair of flaps comprises a plurality of pockets on an external surface thereof.

9. The bag with a transparent compartment of claim 5, wherein the plurality of pockets comprises at least one transparent pocket.

10. The bag with a transparent compartment of claim 1, wherein each attachment device is a zipper.

11. The bag with a transparent compartment of claim 7, wherein each fastener is a zipper.

12. The bag with a transparent compartment of claim 1, further comprising a pair of backpack straps disposed on the external surface of a flap of the pair of flaps.

13. The bag with a transparent compartment of claim 12, wherein each backpack strap of the pair of backpack straps comprises an adjuster thereon.

14. The bag with a transparent compartment of claim 1, further comprising a connection sleeve disposed on the external surface of a flap of the pair of flaps.

15. The bag with a transparent compartment of claim 1, wherein the pair of flaps are sized to completely cover the pair of transparent sidewalls.

* * * * *